US005161944A

United States Patent [19]

Wood

[11] Patent Number: 5,161,944

[45] Date of Patent: Nov. 10, 1992

[54] SHROUD ASSEMBLIES FOR TURBINE ROTORS

[75] Inventor: Anthony G. Wood, London, England

[73] Assignee: Rolls-Royce plc, London, England

[21] Appl. No.: 715,996

[22] Filed: Jun. 17, 1991

[30] Foreign Application Priority Data

Jun. 21, 1990 [GB] United Kingdom ..... 9013893

[51] Int. Cl.[5] ..... F01D 5/20

[52] U.S. Cl. ..... 415/173.3; 415/170.1; 415/173.1

[58] Field of Search ..... 415/173.3, 173.1, 170.1

[56] References Cited

U.S. PATENT DOCUMENTS 4,230,436 10/1980 Davison .
4,529,355 7/1985 Wilkinson ..... 415/173.3 X
4,551,064 11/1985 Pask ..... 415/173.3 X

FOREIGN PATENT DOCUMENTS 881880 11/1961 United Kingdom .
1497619 1/1978 United Kingdom .
1574981 9/1980 United Kingdom .
2117843A 10/1983 United Kingdom .
2119452A 11/1983 United Kingdom .

*Primary Examiner*—Edward K. Look
*Assistant Examiner*—Todd Mattingly
*Attorney, Agent, or Firm*—Oliff & Berridge

[57] ABSTRACT

In a high pressure compressor stage of a gas turbine engine an array of rotor blades is mounted on a rotatable disk or drum and a static shroud is made up of a number of shroud segments. Each segment is provided with two hook portions which each locate through a respective slot or aperture formed in a generally tubular casing structure. The hook portions engage the outer surface of the casing whilst the ends of the shroud members press upon the inner surface of the casing to create an assembly strain which holds each shroud member firmly in position. Cooling air holes are provided in the casing and the shroud segment.

7 Claims, 1 Drawing Sheet

SHROUD ASSEMBLIES FOR TURBINE ROTORS

BACKGROUND OF THE INVENTION

1. Field of the Invention

The present invention relates to an improved shroud assembly for high pressure stages of axial flow compressors and turbines such as are incorporated in gas turbine engines for aircraft.

"Radially", in the context of this specification, means a direction at right angles to the longitudinal axis of the engine, "upstream" means in the direction of the air intake of the engine, "downstream" means in the direction of the engine exhaust, and "circumferentially" refers to the locus traced by the end of a radius rotating about and at right angles to the longitudinal axis of the engine.

Axial flow compressor or turbine rotor blade stages operating at high gas temperatures in gas turbine engines are now being provided with specially designed shroud rings for the purpose of maintaining more nearly optimum clearances between the tips of the rotor blades and the shrouds over as wide a range of rotor speeds and temperatures as possible. The importance of this lies in that blade tip clearances or clearance gaps that are too large reduce the efficiency of the compressor or turbine whilst clearances which are too small may cause damage under some conditions due to interference between the blade tips and the shroud ring.

2. Description of the Prior Art

A known method of maintaining optimum blade tip clearances over a wide range of conditions involves matching the thermal response of the shroud ring and its supporting structure—in terms of increase or decrease of diameter with operating temperature—to the radial growth or shrinkage of the compressor or turbine rotor due to changing centrifugal forces and temperatures. In order to achieve this required matching, the shroud rings are composed of a number of segments, each describing a relatively short arc length circumferentially of the rotor stage.

Such shroud segments are individually connected to the supporting structure surrounding the shroud ring. For instance, the casing round the turbine blades is normally made up from a number of shroud segments each supported by adjacent nozzle guide vane support structures. An increase in the temperature of the gas stream causes thermal expansion of the guide vane support structures, thus causing the shrouds to move radially outwards. The tip clearance between the rotor blades and the shrouds is thereby increased, bringing about an associated drop in turbine efficiency.

However, in gas turbine engines a tip clearance gap has to exist in order that the rotor tips keep clear of the shrouds under various operating conditions. It is usual to adopt a compromise whereby the tip clearance is large enough to avoid contact between the rotor tips and the shrouds but is made as small as possible for maximum efficiency.

A problem that further arises in the design of shroud segments individually connected to a supporting structure is excessive sealing clearance between a shroud segment and its supporting structure. This excessive sealing clearance can arise because of manufacturing tolerances in the production of the shroud segments and the supporting structure, and because of differing thermal expansion or expansion rates between the two types of components as the operating temperatures change.

In the case of compressors, excessive sealing clearances cause decreased efficiency because they allow air on the high pressure side of the rotor to leak between the shroud segments and the supporting structure to the low pressure side of the rotor. In the case of turbines, excessive sealing clearances increase the consumption of the high pressure cooling air which is fed to the shroud segments and the adjacent components to cool them. This reduces the efficiency of the engine. Large sealing clearances also decrease the effectiveness of the cooling air in cooling the shroud segments by allowing cooling air to escape which would otherwise pass through small cooling air passages in the shroud segments.

An object of the present invention is to provide an improved shroud assembly in which the segmented shroud members are supported in such a manner that distortion of the nozzle guide vanes brought about by thermal or other means has a minimal effect on the clearances between shroud members and rotor tips.

BRIEF SUMMARY OF THE INVENTION

Generally, the invention provides an improved shroud assembly for a gas turbine engine in that thermal expansion effects on a shroud segment are reduced by attaching the segment directly to an air cooled part of the engine.

According to the present invention there is provided a shroud assembly for a gas turbine engine, the engine including an array of rotor blades mounted on a rotatable disc or drum, an air cooled tubular casing surrounding the array of blades, and a plurality of circumferential shroud segments located radially between the rotor blades and the casing, wherein each shroud segment is provided with an attachment means arranged to engage the casing and is shaped and dimensioned in relation to the casing so that engagement of said attachment means with the casing causes at least part of the shroud segment to abut the inner surface of the casing thereby subjecting the shroud segment to an assembly strain.

BRIEF DESCRIPTION OF THE DRAWINGS

The invention will now be described by way of example only with reference to the accompanying drawings not to scale in which.

DESCRIPTION OF THE PREFERRED EMBODIMENT

Figure 1:
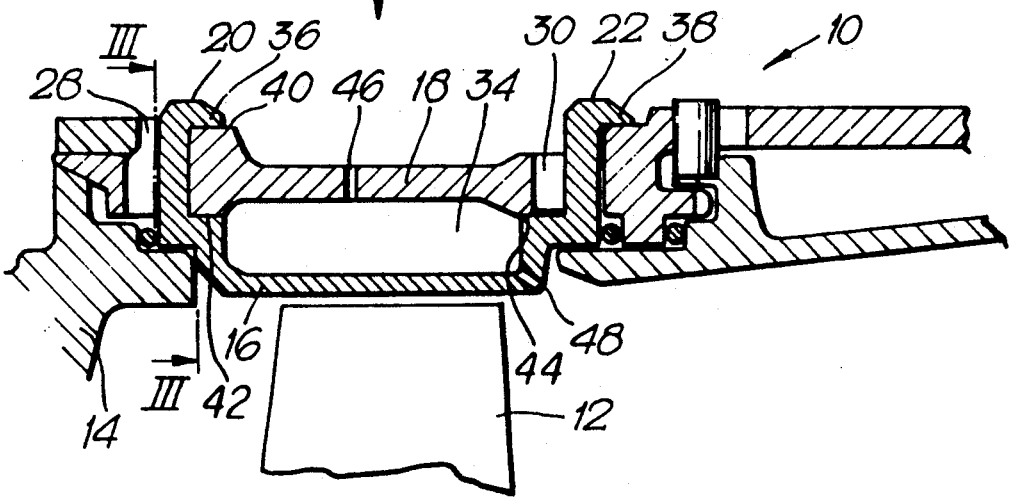
FIG. 1 is a longitudinal section through part of a gas turbine engine showing a shroud assembly in relation to a rotor blade.

Referring to FIG. 1 there is shown a portion of a high pressure compressor stage 10 of a gas turbine engine, comprising, an array of rotor blades 12, an array of nozzle guide vanes 14, upstream of the rotor blades a ring of arcuate shroud segments 16 circumferentially surrounding the rotor blades 12, and a generally tubular casing 18 circumferentially surrounding the ring of shroud segments. For clarity, only the radially outer portions of a single blade 12 and a single vane 14 are shown.

Figure 3:
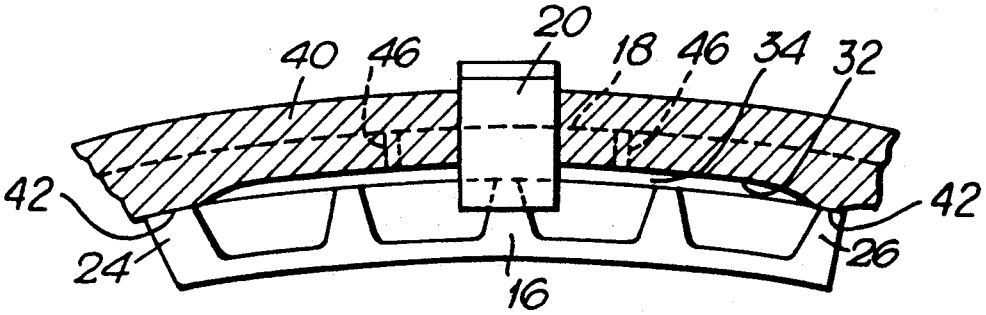
FIG. 3 is a section through a part of the shroud assembly of FIG. 1, taken along line III—III.

Each shroud segment 16 is provided with a pair of integral hooks 20, 22 extending radially outwards from respective upstream and downstream parts of the segment. As shown in FIG. 3, each hook 20, 22 is located midway between the circumferential extremities 24, 26 of the segment 16.

Figure 2:
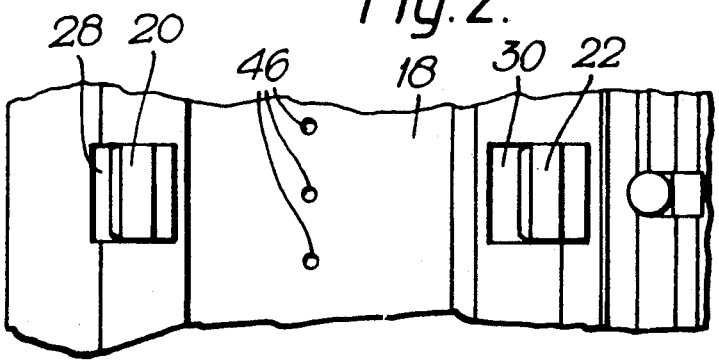
FIG. 2 is a plan view of part of FIG. 1, taken in the direction of arrow II.

As shown in FIGS. 1 and 2, the casing 18 is provided with two circumferential arrays of hook receiving apertures or slots 28, 30 respectively located radially outwards of the said upstream and downstream parts of the shroud segments 16. Further, each slot 28, 30 is located midway between the circumferential extremities 24, 26 of the segment 16.

As shown in FIG. 3, a radially inner surface 32 of the casing 18 abuts the circumferential extremities 24, 26 of the segment 16, but is spaced from the segment between said extremities by a space 34. This spacing may be achieved in a number of ways. For instance, as illustrated, the inner surface 32 of the casing 18 may be arch shaped, the radius of curvature changing from a relatively large value in the middle to a value at the extremities 24, 26 of the segment 16 less than the radius of curvature of the segment. Alternatively, the radius of curvature of the inner surface 32 may be constant but less than that of the segment, thereby ensuring that the segment abuts the casing only at its said extremities.

Each hook 20, 22 projects through a respective said slot 28, 30 in the casing 18 so that a respective radially outer portion 36, 38 of the hook engages a radially outer surface 40 of the casing.

Upstream and downstream portions 42, 44 of the circumferential extremities 24, 26 of the segment 16 lying radially inwards of the casing 18 and circumferentially on either side of the respective hook receiving slots 28, 30 abut the inner surface 32 of the casing so as to provide a reaction against the engagement of the radially outer portion of the respective hook 20, 22 with the outer surface 40 of the casing. The segment 16 is thus held in place by a small assembly strain created by a radially outward force applied at the midpoint by virtue of the engagement of the hooks 20, 22 with the casing 18 and the abutment of the extremities of the segment against the casing. The engagement strain will increase slightly during running of the engine as the shroud member length increases with temperature.

The engagement strain allows for the shroud members inner surface to be ground to the optimum size for minimum tip clearance after allowing for growth of the rotor blades and any temperature changes during transient running conditions.

The casing 18 is shielded from the hot gases flowing through the turbine by the shroud segments 16 and the nozzle guide vanes 14. The casing is cooled by air impingement and forms a stable structure for the shroud segments to be mounted on.

Each shroud member 16 is cooled by air fed through a plurality of holes 46 in the outer face of the casing 18. This air passes over the shroud member and into the main gas stream via a further set of holes 48 in the downstream section of the shroud member.

I claim:

1. A shroud assembly for a gas turbine engine, the engine including:

at least one rotor blade, an air cooled tubular casing located radially outward of the at least one blade, and at least one circumferential shroud segment located radially between the at least one blade and the casing, the at least one shroud segment being provided with an attachment means arranged to engage the casing and shaped and dimensioned in relation to the casing so that engagement of said attachment means with the casing causes at least part of the at least one shroud segment to abut the inner surface of the casing thereby subjecting the at least one shroud segment to an assembly strain, wherein the attachment means is located between circumferentially opposed extremities of the at least one shroud segment and the at least one shroud segment is shaped so that the opposed extremities abut the inner surface of the casing, and that portion of the at least one shroud segment between the extremities is spaced from the casing.

2. A shroud assembly as claimed in claim 1 wherein the radius of the circumferential curvature of the radially outer surface of the at least one shroud segment is greater than that of at least part of the inner surface of the casing whereby the circumferential extremities of the at least one shroud segment abut the inner surface of the casing and the portion of the at least one shroud segment lying between its said extremities is spaced from the casing.

3. A shroud assembly as claimed in claim 1 wherein the casing is provided with at least one circumferential array of slots, at least one slot corresponding to the at least one shroud segment, and the attachment means is provided by hook means adapted to extend radially outwards from the at least one shroud segment through a said corresponding slot in the casing and to engage the outer surface of the casing.

4. A shroud assembly as claimed in claim 3 wherein the hook means is located substantially midway between opposed circumferential extremities of the segment.

5. A shroud assembly as claimed in claim 2 wherein the hook means is provided by a pair of hooks each extending respectively from upstream and downstream regions of the at least one shroud segment and there are provided two said circumferential arrays of slots, a slot from each array corresponding to a respective hook.

6. A shroud assembly as claimed in claim 3 wherein the or each hook means is integral with the at least one shroud segment.

7. A shroud assembly as claimed in claim 1 wherein the casing is provided with at least one cooling hole arranged to direct cooling air to the at least one shroud segment and the at least one shroud segment is provided with at least one cooling exit hole through which spent cooling air passes.

* * * * *